US009657241B2

(12) United States Patent
Johnson et al.

(10) Patent No.: US 9,657,241 B2
(45) Date of Patent: May 23, 2017

(54) METHOD AND APPARATUS FOR REDUCING PHOSPHORUS IN CRUDE REFINING

(71) Applicant: Marathon Petroleum Company LP, Findlay, OH (US)

(72) Inventors: James F. Johnson, Woodhaven, MI (US); Phillip Ryan Adams, Flatwoods, KY (US)

(73) Assignee: Marathon Petroleum Company LP, Findlay, OH (US)

( * ) Notice: Subject to any disclaimer, the term of this patent is extended or adjusted under 35 U.S.C. 154(b) by 2 days.

(21) Appl. No.: 14/854,641

(22) Filed: Sep. 15, 2015

(65) Prior Publication Data

US 2016/0075956 A1 Mar. 17, 2016

Related U.S. Application Data

(60) Provisional application No. 62/050,993, filed on Sep. 16, 2014.

(51) Int. Cl.

| | |
|---|---|
| ***C10G 31/06*** | (2006.01) |
| ***C10G 75/00*** | (2006.01) |
| ***C10G 7/00*** | (2006.01) |
| *C10G 31/00* | (2006.01) |

(52) U.S. Cl.

CPC ..... *C10G 75/00* (2013.01); *C10G 7/00* (2013.01); *C10G 31/06* (2013.01); *C10G 2300/202* (2013.01); *C10G 2400/08* (2013.01)

(58) Field of Classification Search

CPC ..... C10G 31/00; C10G 31/06; C10G 75/00

See application file for complete search history.

(56) References Cited

U.S. PATENT DOCUMENTS

| | | | | |
|---|---|---|---|---|
| 7,172,686 | B1 * | 2/2007 | Ji | B01D 3/06 208/251 R |
| 2015/0122704 | A1 * | 5/2015 | Kumar | C10G 7/00 208/361 |

* cited by examiner

*Primary Examiner* — Brian McCaig

(74) *Attorney, Agent, or Firm* — Emch, Schaffer, Schaub & Porcello Co., L.P.A.

(57) ABSTRACT

A method and apparatus for the reduction of fouling in a crude unit. Chemicals containing Phosphorous are understood to be utilized in the production or transportation of certain types of crude oils. It is believed that the elevated levels of phosphorus are contributing to the excessive fouling observed in the preheat exchanger circuits and crude heaters.

20 Claims, 1 Drawing Sheet

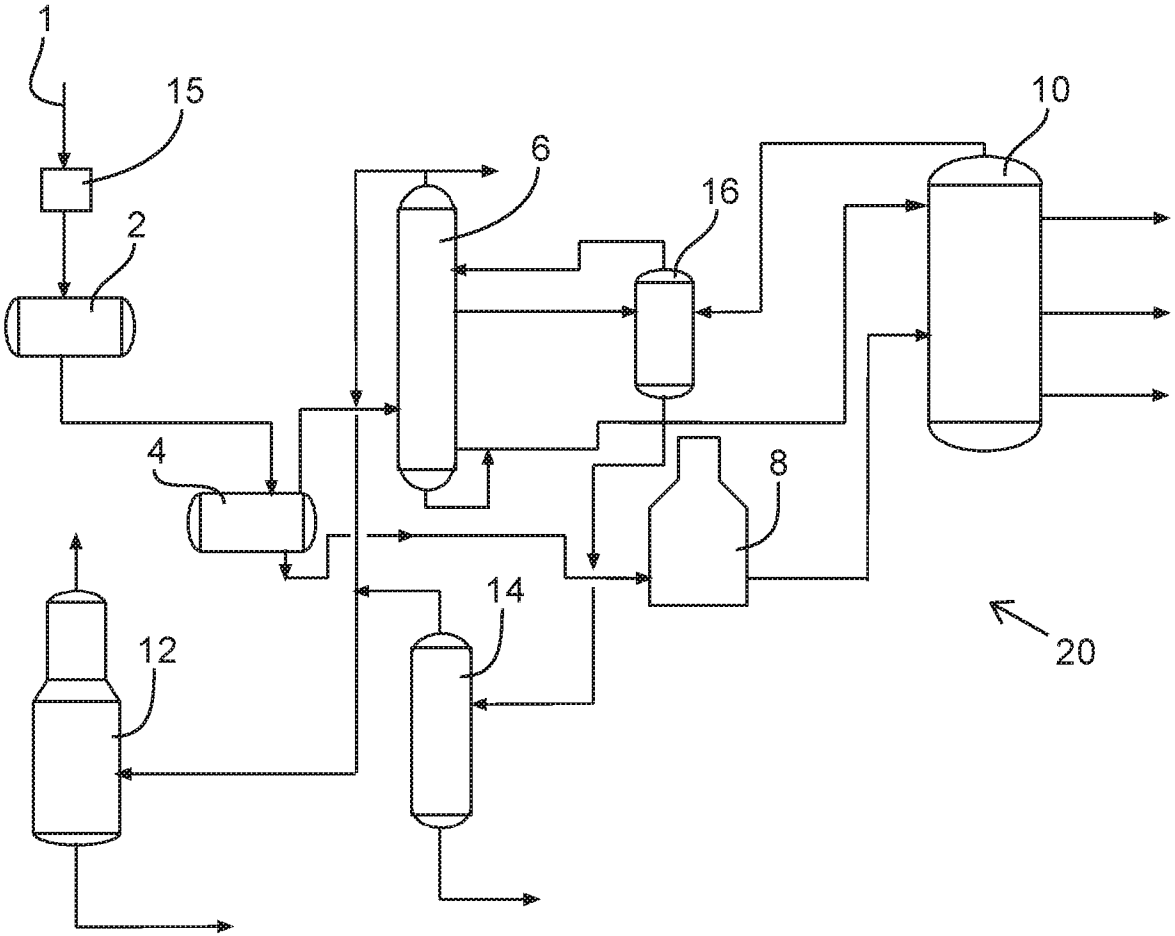
1
15
2
4
6
16
10
8
14
12
20

METHOD AND APPARATUS FOR REDUCING PHOSPHORUS IN CRUDE REFINING

CROSS REFERENCE TO RELATED APPLICATION

The present patent application claims the benefit of U.S. provisional patent application No. 62/050,993 filed Sep. 16, 2014.

BACKGROUND OF THE INVENTION

At an oil refinery, crude oil is brought in, generally through a pipeline, at a temperature of approximately 50-70° F. Before the crude oil enters a crude heater, the crude is pre-heated to a desired temperature to optimize the performance of the crude heater and reduce fuel costs. Once the crude oil is pre-heated to a desired temperature of 350-400° F., it enters a flash drum or flash tower, wherein the lighter hydrocarbons (such as butane, propane and gasoline) are removed from the crude oil by evaporation or flashing. The remaining crude oil is then transferred to the crude heater for further heating prior to separation in the crude tower.

It is well known that fouling in the preheat circuit, progressively worsens as the crude temperature increases, cumulating with the most extensive fouling being observed in the crude heater. Fouling has also been observed in kerosene sections of the crude tower with excessive levels of phosphorus not normally expected nor historically observed in the foulants. Samples of the coke obtained from the pre-heat exchangers and crude heaters indicate these elevated levels of phosphorus. Phosphorus is known to reduce corrosion. Chemicals containing Phosphorous are understood to be utilized in the production or transportation of certain types of crude oils. It is believed that the elevated levels of phosphorus are contributing to the excessive fouling observed in the preheat exchanger circuits and crude heaters.

SUMMARY OF THE INVENTION

The present invention provides an apparatus and method for the reduction of fouling in the refining of crude oil due to Phosphorous.

Crude oil is refined by separating hydrocarbons at high temperatures. The products produced (naphtha, diesel fuel, gasoline, asphalt, etc.) must be cooled before being transported to storage. One method of cooling passes the product through a heat exchange equipment, whereby the temperature of the finished product is cooled and the temperature of the crude oil is increased. Any number of heat exchangers can be utilized to reach the desired temperature of the crude, and to reduce the temperature of the product. A furnace is then utilized to further heat the crude oil prior to entering the crude tower for fractionation. To increase efficiency of this heat exchange process, it is common for refineries to utilize a flash drum or flash tower that is installed mid-way through the heat exchange process. This equipment allows light hydrocarbons, and contaminants such as water, to flash or be released from the oil, as further heating of this material is not required. The removal, by flashing, of the light material and contaminants increases the efficiency of the further heat exchanging equipment and furnace. The present invention utilizes multiple heat exchangers to increase the temperature of the crude oil well past the accepted industry norm of 350-400° F. In the present invention, the crude oil is heated to approximately 450-500° F. before entering the flash drum or flash tower. This higher temperature range results in greater separation of the lighter hydrocarbon chains, and removal of contaminants such as water. Specifically, kerosene is separated out in the flash tower or flash drum at this temperature range, while it is not separated out at 350-400° F. Once the light hydrocarbons have been removed, the crude oil is preheated further in additional heat exchangers then sent to the crude heater.

The removal of the additional contaminants and light hydrocarbons, specifically kerosene at the flash tower or flash drum, results in lower phosphorus levels downstream in the crude heater and other vessels. This reduction in phosphorus has been shown to decrease unwanted fouling in downstream vessels. This discovery runs contrary to the long held belief that heating the crude oil past 350-400° F. was undesirable and inefficient. If the crude oil is to be maintained in a liquid state prior to flashing, the pressure of the crude oil must be increased to maintain the crude oil in a liquid state when the temperature is increased to 450-500° F. Pursuant to the ideal gas law, $PV=nRT$, an increased temperature requires an increased pressure to maintain the liquid phase. This increased pressure results in a strain on the entire refining system components, resulting in a shorter replacement cycle for the components. Therefore, it was believed to be undesirable and inefficient to maintain the crude oil in a liquid state and operate at a higher temperature. We have discovered, however the benefits of raising the crude oil to 450-500° F., prior to flashing; the phosphorus in the crude oil is reduced significantly, and the phosphorous remaining is not in a form that induces fouling, thus downstream fouling is greatly reduced. We have discovered that the benefits of raising the temperature of the crude oil outweighs the risk of straining the refinery system components.

In the preferred embodiment, multiple heat exchangers are used to raise the crude oil to a range of 450-500° F. prior to flashing. Once the crude oil enters the flash drum, or flash tower, the higher temperature results in more light hydrocarbon chains, including kerosene, and water being removed from the crude oil prior to entering the crude heater. The light hydrocarbons flash from the crude oil and are passed to a fractionation tower and on to the crude tower, bypassing the remaining preheat circuit and crude heater. This reduction in light hydrocarbons reduces the phosphorus found in the crude oil, thereby reducing fouling in the crude heater and downstream vessels.

Another element of the present invention provides that the flashed light hydrocarbons, specifically the tower bottoms, are routed directly to the crude tower and bypass other vessels downstream that have normally experienced significant fouling. These tower bottoms bypass the preflash exchanger train (a number of heat exchangers) and the crude heater. By directing the tower bottoms around the preflash exchanger train and the crude heater, phosphorous levels are decreased in the preflash exchanger train and the crude heater and results in significantly less fouling of the components.

Therefore an object of the invention is to reduce phosphorous fouling of the preflash exchanger train and the crude heater. Other objects and advantages of the present invention will become apparent to those skilled in the art upon a review of the following detailed description of the preferred embodiments and the accompanying drawings.

IN THE DRAWINGS

The FIGURE is a schematic drawing of the crude/flash separator of the present invention.

DETAILED DESCRIPTION OF THE INVENTION

Referring now to the FIGURE, the crude oil 1, or raw crude, enters the refinery from a pipeline at ground temperature of about 50-70° F. The crude oil 1 is stored in tanks (not shown) until it is transferred to the crude unit 20, where it is heated by passage through at least one heat exchangers 15 to increase the temperature of the crude oil 1 to approximately 300° prior to entering a desalter 2. The heat exchangers increase the temperature of the crude oil 1 while, reducing the temperature of the finished product. Crude oil enters a desalter 2 where salt is removed, or washed, from the crude. The crude oil, now called desalted crude, is pumped through additional heat exchangers, raising the temperature in excess of 450° F., before entering a flash drum 4. In the preferred embodiment, the desalted crude is heat to 500° F. In the flash drum 4 light hydrocarbons and contaminants contained in the crude oil are vaporized, or flashed, and are thus removed from the desalted crude. In the preferred embodiment the flashed light hydrocarbons and contaminants include kerosene range material and water that is known where the buildup of phosphorus occurs.

The flashed light hydrocarbons from the flash drum are routed to a flash tower 6. In the flash tower, naphtha is separated from the light hydrocarbons. While the heavier hydrocarbons, known as tower bottoms, are routed directly to the crude tower 10 and bypass other vessels downstream, including the crude heater 8. The naphtha is transferred to a stripper 16 where the light gases are removed. The naphtha is then transferred to a naphtha stripper 12 where the light and heavy naphtha is separated. The stripped naphtha is further separated at a debutanizer 12, separating the propane and butane.

The crude oil from the flash drum 4, now called flashed crude, is pumped through additional heat exchangers, and on to a crude heater 8. By removing kerosene and insuring that all of the water content is reduced from the crude, the phosphorous fouling of the heat exchanger and crude heater is reduced significantly. The outlet of the crude heater 8 is piped directly to the crude tower 10, where the crude oil is separated into finished products.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A method of reducing the levels of phosphorous in the process of refining oil comprising the steps of:
- heating crude oil in an at least one heat exchanger, to a temperature ranging between 450-500° F.;
- transferring the heated crude oil to a flash separator;
- separating and removing kerosene from the crude oil in the flash separator; and
- transferring the flashed crude oil, having a reduced phosphorus content, to a crude heater.

2. The method according to claim 1 wherein the flash separator is a flash drum.

3. The method according to claim 1 wherein the flash separator is a flash tower.

4. The method according to claim 1 wherein the flash separator is a flash drum and a flash tower.

5. The method according to claim 1 wherein the crude oil is heated to a temperature exceeding 475° F.

6. A method of refining oil comprising the steps of:
- heating crude oil in an at least one heat exchanger, to a temperature ranging between 450-500° F.;
- transferring the heated crude oil to a flash drum;
- separating and removing kerosene from the crude oil in the flash drum;
- transferring the crude oil to a flash tower;
- further separating and removing kerosene from the crude oil in the flash tower; and
- transferring the flashed crude oil to a crude heater.

7. A method of refining oil comprising the steps of:
- heating crude oil, in an at least one heat exchanger, to a temperature exceeding 450° F.;
- transferring the heated crude oil to a flash tower;
- separating and removing kerosene from the crude oil in the flash tower; and
- transferring the flashed crude oil to a crude heater.

8. A method of refining oil comprising the steps of:
- heating crude oil in an at least one heat exchanger, to a temperature ranging between 450-500° F.;
- separating, thereby reducing the level of phosphorous in the crude oil and removing kerosene from the crude oil in a flash separator; and
- transferring the flashed crude oil to a crude heater.

9. The method of refining oil according to claim 8 wherein the flash separator is a flash drum.

10. The method of refining oil according to claim 9 wherein the flash separator is a flash tower.

11. The method of refining oil according to claim 9 wherein the flash separator is a flash drum and a flash tower.

12. The method of refining oil according to claim 9 wherein the crude oil is heated with multiple heat exchangers.

13. A process for reducing phosphorus content in crude oil comprising:
- heating crude oil in an at least one heat exchanger, to a temperature ranging between 450-500° F.;
- increasing the pressure on the heated crude oil to maintain the crude oil in a liquid state;
- transferring the crude oil to the flash separator;
- separating and removing kerosene from the crude oil in the flash separator; and
- transferring the flashed crude oil, having a reduced phosphorus content to a crude heater.

14. The process for reducing phosphorous content in crude oil according to claim 13 wherein the flash separator is a flash drum.

15. The process for reducing phosphorous content in crude oil according to claim 13 wherein the flash separator is a flash tower.

16. The process for reducing phosphorous content in crude oil according to claim 13 wherein the flash separator is a flash drum and a flash tower.

17. A process for reducing phosphorous content in crude oil comprising:
- heating crude oil, prior to entering a flash separator, in an at least one heat exchanger, to a temperature ranging between 450-500° F.;
- increasing the pressure on the crude oil to maintain the crude oil in a liquid state;
- transferring the crude oil to the flash separator;

separating and removing kerosene and tower bottoms from the crude oil in the flash separator;

transferring the kerosene and tower bottoms to a preflash exchanger and a crude heater; and transferring a flashed crude oil, having a reduced phosphorus content, to the crude heater.

18. A process for reducing phosphorous content in crude oil comprising:

heating crude oil, prior to entering a flash separator, in an at least one heat exchanger, to a temperature ranging between 450-500° F.;

increasing the pressure on the crude oil to maintain the crude oil in a liquid state;

transferring the crude oil to the flash separator; and separating and removing kerosene and tower bottoms from the crude oil in the flash separator to create or reduce an crude oil having a reduced phosphorus content.

19. A method of reducing the levels of phosphorous in the process of refining oil comprising the steps of:

heating crude oil, in an at least one heat exchanger, to a temperature between approximately 450-500° F.;

transferring the heated crude oil to a flash separator;

separating and removing light hydrocarbons and contaminants from the crude oil in the flash separator;

transferring the light hydrocarbons, having a reduced phosphorus content, to a crude tower, by passing a crude heater; and transferring the any remaining crude oil to the crude heater.

20. A method for reducing the levels of phosphorus in the process of refining oil comprising the steps of:

heating crude oil, in an at least one heat exchanger, to a temperature between approximately 450-500° F.;

transferring the heated crude oil to a flash separator;

flashing the crude oil in the flash separator to create flashed crude oil and unflashed crude oil;

transferring the flashed crude oil, having a reduced phosphorus content, to a crude tower, by passing a crude heater; and transferring any remaining crude oil to the crude heater.

* * * * *